US008607516B2

(12) United States Patent
O'Brien

(10) Patent No.: US 8,607,516 B2
(45) Date of Patent: Dec. 17, 2013

(54) QUOIN CONSTRUCTION AND INSTALLATION SYSTEM

(76) Inventor: John Patrick O'Brien, Fallbrook, CA (US)

( * ) Notice: Subject to any disclaimer, the term of this patent is extended or adjusted under 35 U.S.C. 154(b) by 33 days.

(21) Appl. No.: 13/115,579

(22) Filed: May 25, 2011

(65) Prior Publication Data

US 2011/0289874 A1 Dec. 1, 2011

Related U.S. Application Data

(60) Provisional application No. 61/349,312, filed on May 28, 2010.

(51) Int. Cl.
*E04B 2/00* (2006.01)
*E04F 13/00* (2006.01)
*E04F 15/00* (2006.01)

(52) U.S. Cl.
USPC ..... 52/287.1; 52/288.1; 52/311.1; 52/716.1

(58) Field of Classification Search
USPC ..... 52/57, 58, 97, 211, 212, 287.1, 288.1, 52/311.1, 314, 656.1, 658, 716.1, 717.01, 52/745.02
See application file for complete search history.

(56) References Cited

U.S. PATENT DOCUMENTS 2,255,736 A * 9/1941 Odell ..... 52/278
2,373,789 A * 4/1945 Smith ..... 52/282.3
5,029,424 A * 7/1991 Hingos ..... 52/314
5,347,784 A * 9/1994 Crick et al. ..... 52/520
5,664,376 A * 9/1997 Wilson et al. ..... 52/287.1
6,219,980 B1 * 4/2001 Peck, Jr. ..... 52/288.1
6,354,049 B1 * 3/2002 Bennett ..... 52/287.1
6,405,503 B1 * 6/2002 Reed ..... 52/288.1
6,625,950 B1 * 9/2003 Shreiner et al. ..... 52/718.01
6,631,600 B2 * 10/2003 Schiedegger et al. ..... 52/658
6,883,282 B1 * 4/2005 Newhart, III ..... 52/287.1
7,793,474 B2 9/2010 Tyler et al.
7,861,476 B2 * 1/2011 Bezubic, Jr. ..... 52/288.1
2002/0189181 A1 * 12/2002 Kreitz et al. ..... 52/288.1
2003/0145553 A1 * 8/2003 Schiedegger et al. ..... 52/658
2003/0226327 A1 * 12/2003 Perry ..... 52/287.1
2004/0118062 A1 * 6/2004 Meijer et al. ..... 52/287.1
2005/0262784 A1 * 12/2005 Justice ..... 52/287.1
2007/0137127 A1 * 6/2007 Lincoln et al. ..... 52/384
2007/0193147 A1 * 8/2007 Dugger ..... 52/287.1
2009/0235596 A1 * 9/2009 Tyler et al. ..... 52/287.1
2010/0242387 A1 * 9/2010 Cashman ..... 52/287.1
2011/0094174 A1 * 4/2011 Meahl ..... 52/288.1
2011/0185662 A1 * 8/2011 Mollinger et al. ..... 52/309.4
2011/0185670 A1 * 8/2011 Mitchell et al. ..... 52/539
2011/0315298 A1 * 12/2011 Bennett et al. ..... 156/71

* cited by examiner

*Primary Examiner* — Ryan Kwiecinski
(74) *Attorney, Agent, or Firm* — Kelly & Kelley, LLP

(57) ABSTRACT

A process for installing quoins to a building structure includes fabricating a plurality of quoins, each including two quoin panels angularly disposed relative to each other and connected along a common edge. A true edge column is attached to the building structure, the true edge column including two column panels angularly disposed relative to each other along a common column edge. The plurality of quoins are then attached in stacked relation over and to the true edge column. Each of the quoins may include an outer and an inner surface, wherein the inner surface comprises a right-angled recess adjacent to the common edge and along the two quoin panels. The true edge column may be cooperatively sized to fit within the right-angled recess. A plurality of pre-drilled apertures may be disposed about the right-angle recess for fastening the quoins to the true edge column and building structure.

21 Claims, 7 Drawing Sheets

QUOIN CONSTRUCTION AND INSTALLATION SYSTEM

FIELD OF THE INVENTION

The present invention generally relates to quoins. More particularly, the present invention relates to pre-fabricated decorative quoins that are assembled to existing corners and walls.

BACKGROUND OF THE INVENTION

Quoins are the cornerstones of brick, stone walls or stucco buildings. Quoins may be either structural or decorative. Architects and builders use quoins to give the impression of strength and firmness to the outline of a building. Rough-finished or rusticated masonry is also frequently used for foundation layers of buildings to give the same impression. Quoining can be carried out in stone on a stone building, with stone on a predominantly brick building, or by laying brick masonry to give the appearance of blocks at the corner. If structural, quoins are usually part of load-bearing walls; if decorative, they may be made of a variety of materials including brick, stone, concrete and wood. The most common form of decorative use for a quoin is the use of an alternative pattern of rectangles that wrap around the wall, mimicking the pattern of stone blocks or brick as they would wrap around a corner and thus join the two walls. In Georgian architecture, wooden quoins were most often part of an overall theme to imply stone, and thus permanence.

Historically these architectural quoins were just seen on the finest homes and buildings of the time. Quoins typically involved masonry skills during the time of the home's/building's construction. For these reasons, adding quoins to one's property to enhance its curb appeal has not been within reach of the typical do-it-yourselfer. Accordingly, there is a need for pre-fabricated quoins that are easily installed. The present invention fulfills these needs and provides other related advantages.

SUMMARY OF THE INVENTION

A process for installing quoins to a building structure includes fabricating a plurality of quoins. Each quoin includes two quoin panels angularly disposed relative to each other and connected along a common edge. The process includes attaching a true edge column to the building structure. The true edge column includes two column panels angularly disposed relative to each other along a common column edge. The process then includes attaching the plurality of quoins in stacked relation over and to the true edge column.

In an exemplary embodiment, the two quoin panels are perpendicularly disposed relative to each other. The two column panels may also be perpendicularly disposed relative to each other.

The step of attaching the true edge column to the building structure may include the step of attaching the true edge column along and aligned with a corner of a wall or building. A longitudinal length of the true edge column may be approximately the height of a portion of the building structure to which the quoins are to be installed.

The step of attaching the plurality of quoins in stacked relation over and to the true edge column includes the step of placing the quoins above one another and aligned with the corner of the wall or building.

The process may also include the step of applying a primer to the quoins.

Each of the quoins may include an outer and an inner surface, wherein the inner surface comprises a right-angled recess adjacent to the common edge and along the two quoin panels. The true edge column may be cooperatively sized to fit within the right-angled recess.

The process may include the step of caulking around a gap between the quoins and the building structure. The process may also include the step of painting the outer surface of the quoins.

The step of attaching the quoins to the true edge column may include use of pre-drilled apertures through the quoins. Additionally, each of the quoins includes a stylized texture outer surface.

Furthermore, an exemplary embodiment may include the step of installing a spacer between the plurality of quoins. The embodiment may also include the step of installing an end cap above an upper-most quoin of the plurality of quoins and below a lower-most quoin of the plurality of quoins.

A process for installing quoins to a building structure includes the step of fabricating a plurality of quoins, where each quoin includes two quoin panels generally perpendicularly disposed relative to each other and connected along a common edge. The process includes attaching a true edge column along and aligned with a corner of the wall or building structure. The true edge column may include two column panels perpendicularly disposed relative to each other along a common column edge. The true edge column may have a longitudinal length approximately the height of a portion of the building to which the quoins are to be installed. The plurality of quoins may be attached in stacked relation over and to the true edge. Each of the quoins may include an outer and an inner surface wherein the inner surface comprises a right-angled recess adjacent to the common edge and along the two quoin panels. The true edge column may be cooperatively sized to fit within the right-angled recess.

The process may include the step of caulking around a gap between the quoins and the building structure. The process may include the step of painting the outer surface of the quoins.

Each of the quoins may include a plurality of pre-drilled apertures to facilitate fastening the quoins to the true edge column. Each of the quoins may include a stylized texture outer surface.

An exemplary prefabricated quoin installation kit for attachment to a building structure may include a true edge column. The true edge column includes two column panels angularly disposed relative to each other along a common column edge. A plurality of stackable prefabricated quoins each include two quoin panels angularly disposed relative to each other and connected along a common quoin edge. Each quoin includes an outer and inner surface wherein the inner surface comprises an angular recess adjacent to the common quoin edge for receiving the true edge column therein.

The two column panels may be connected to one another along the common column edge. The two column panels may be perpendicularly disposed relative to each other and the two quoin panels may be perpendicularly disposed relative to each other.

Each of the prefabricated quoins may include a plurality of pre-drilled apertures for facilitating attachment of the quoins to the true edge column.

Each of the prefabricated quoins may include a stylized texture outer surface. The prefabricated quoins may be made from wood, composite, metal, fiberglass or plastic. The stackable prefabricated quoins may include at least two different types of complementary quoins.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
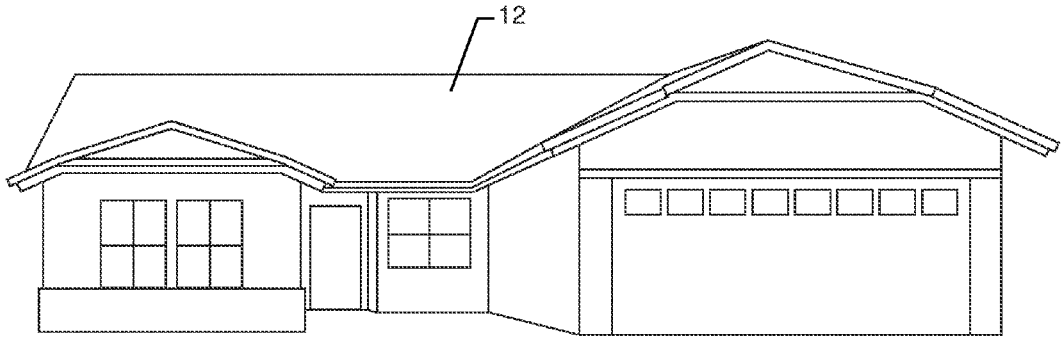
FIG. 1 is a perspective view of a residential home before the present invention was added.
Figure 2:
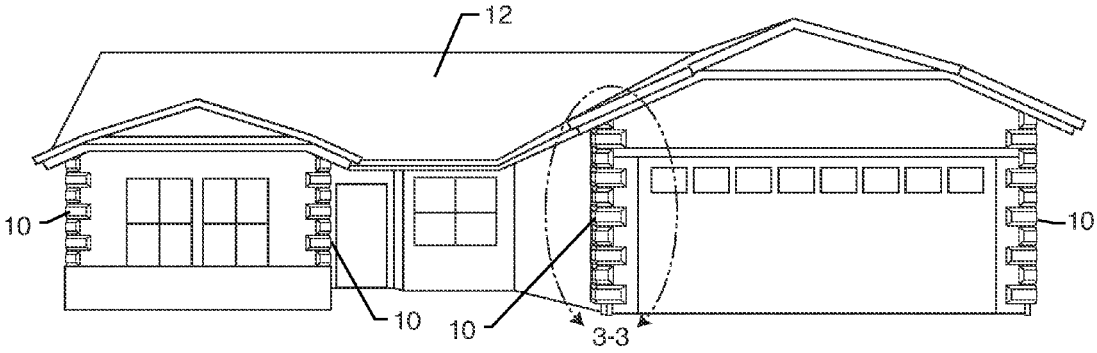
FIG. 2 is a perspective view of the home of FIG. 1 now with an exemplary prefabricated quoin installation kit embodying the present invention.

An exemplary prefabricated quoin installation kit 10 for attachment to a building structure 12 is shown in FIG. 2. FIG. 1 is a perspective view of a residential home 12 before the quoin installation kit 10 was added. FIG. 2 is a perspective view of the home of FIG. 1 now with the prefabricated quoin installation kit 10 installed. In FIG. 1, the quoin installation kit 10 has been added at the edges of the garage door structure and also at the edges of the far-side window structure. The quoin installation kit 10 adds curb appeal and value to the home 12 by making it look more appealing. Traditionally quoins were reserved mostly for brick and rock buildings, but here the quoin installation kit 10 has been used overtop a stucco finish. The quoin installation kit 10 can also be installed over wood, brick or rock.

Figure 7:
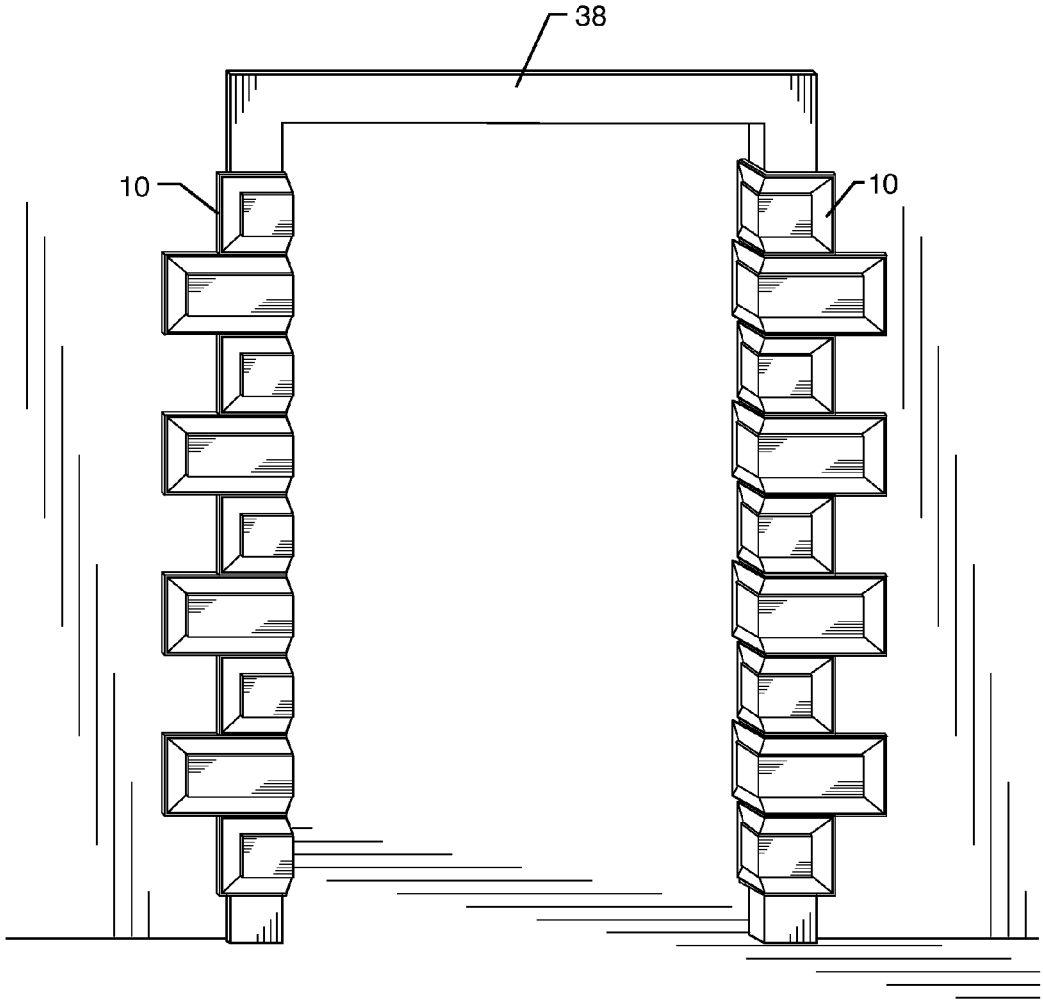
FIG. 7 is a perspective view of an exemplary prefabricated quoin installation kit embodying the present invention now installed inside a doorway.

The present invention can be used to not only enhance the exterior of a structure 12, but also the interior of a structure as shown in FIG. 7. In the past, a purchase of a new garage door was routinely done to enhance the perceived value of one's home. In addition to this, various landscaping improvements could also help the perceived value. Now, the structure of the house can also be enhanced with the quoin installation kit 10. The quoin installation kit 10 can now be installed without experienced masonry skills or the associated costs.

Figure 3:
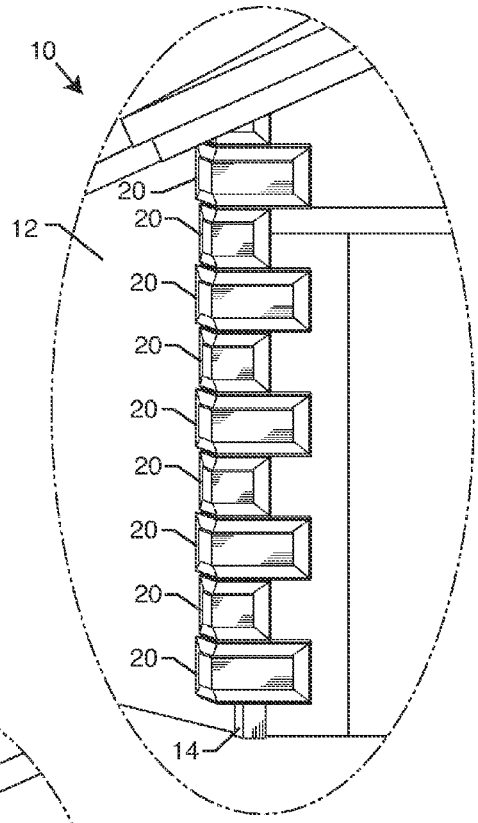
FIG. 3 is enlarged view of the structure of FIG. 2 taken along line 3-3.
Figure 4:
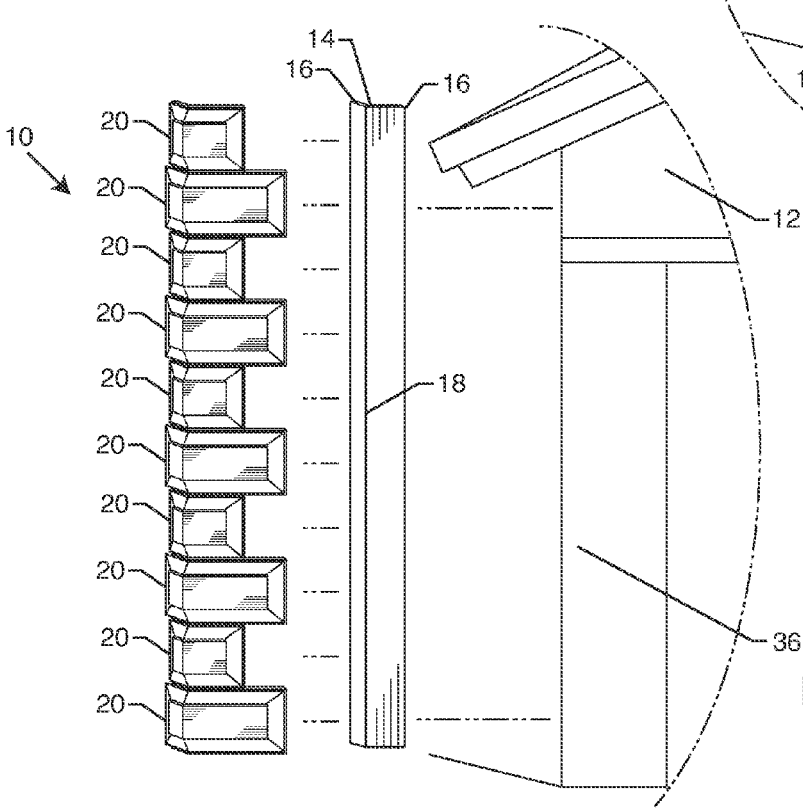
FIG. 4 is an exploded view of the structure of FIG. 3.
Figure 5:
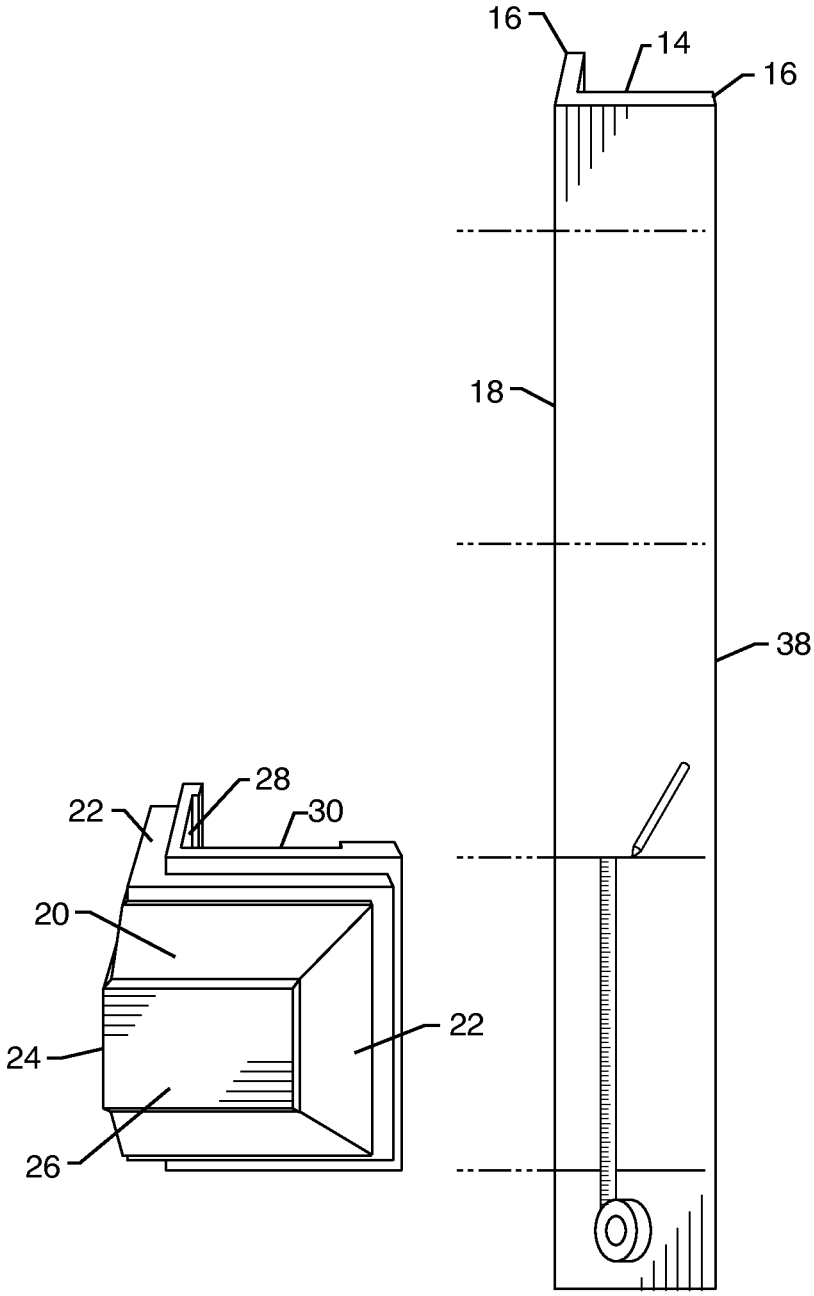
FIG. 5 is a perspective view of an exemplary quoin being measured to attach to an exemplary true edge column.

FIG. 3 is enlarged view of the structure of FIG. 2 taken along line 3-3. FIG. 4 is an exploded view of the structure of FIG. 3. The quoin installation kit may include a true edge column 14. The true edge column 14 is best shown in FIG. 5. The true edge column 14 includes two column panels 16 angularly disposed relative to each other along a common column edge 18.

A plurality of stackable prefabricated quoins 20 each include two quoin panels 22 angularly disposed relative to each other and connected along a common quoin edge 24. Each quoin 20 includes an outer surface 26 and inner surface 28 wherein the inner surface 28 comprises an angular recess 30 adjacent to the common quoin edge 24 for receiving the true edge column 14 therein. The two column panels 16 may be perpendicularly disposed relative to each other and the two quoin panels 22 may be perpendicularly disposed relative to each other.

Each of the prefabricated quoins 20 may include a plurality of pre-drilled apertures 32 for facilitating attachment of the quoins 20 to the true edge column 14. Fasteners 34 may then be used to fasten the quoins 20 to the true edge column 14.

Each of the prefabricated quoins 20 may include a stylized texture outer surface 26. As can be seen by one skilled in the art when referring to the figures, the stylized texture outer surface 26 can include a range of angles and surfaces such that it is aesthetically pleasing, as this disclosure is not intended to limit it to the precise form shown and described herein. The prefabricated quoins 20 may be made from wood, composite, metal, fiberglass or plastic. As can also be seen in the figures, the stackable prefabricated quoins 20 may include at least two different types of complementary quoins 20. As shown herein, a larger and a smaller quoin 20 are placed together to create an aesthetically pleasing combination.

Figure 6:
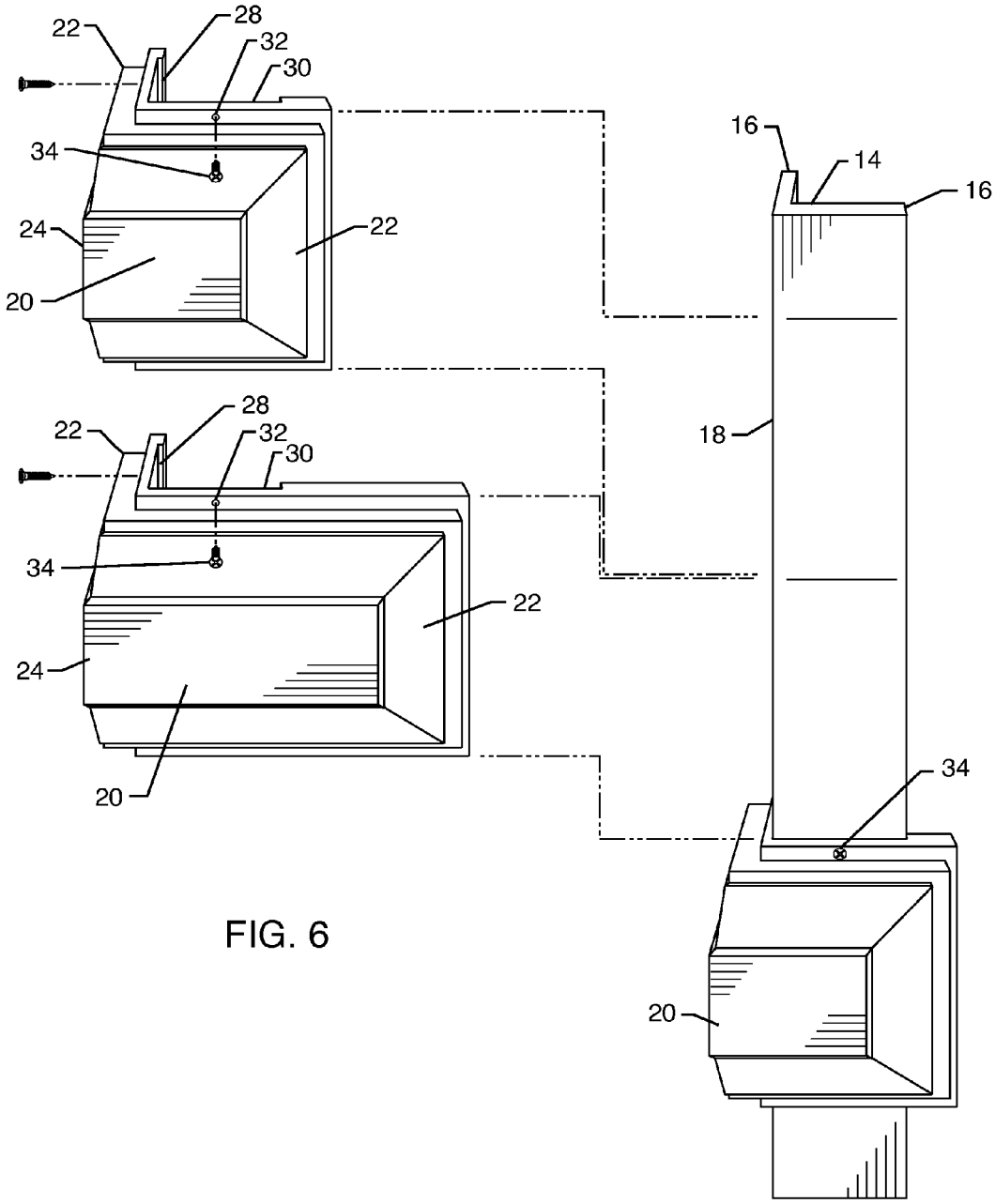
FIG. 6 is a perspective view of an exemplary plurality of quoins attaching to a true edge column.

FIG. 5 is a perspective view of an exemplary quoin 20 being measured to attach to an exemplary true edge column 14. FIG. 6 is a perspective view of an exemplary plurality of quoins 20 attaching to a true edge column 14. The process for installing quoins 20 to a building structure 12 includes fabricating a plurality of quoins 20. Each quoin 20 includes two quoin panels 22 angularly disposed relative to each other and connected along a quoin common edge 24. The process includes attaching a true edge column 14 to the building structure 12. The true edge column 14 includes two column panels 16 angularly disposed relative to each other along a common column edge 18. The process then includes attaching the plurality of quoins 20 in stacked relation over and to the true edge column 14. In an exemplary embodiment, the two quoin panels 22 are perpendicularly disposed relative to each other and the two column panels 16 may also be perpendicularly disposed relative to each other.

The step of attaching the true edge column 14 to the building structure may include the step of attaching the true edge column 14 along and aligned with a corner 36 of a wall or building 12 as shown in FIG. 4. A longitudinal length 38 of the true edge column may be approximately the height of a portion of the building structure 12 to which the quoins 20 are to be installed. The quoins 20 may be placed above one another and aligned with the corner 36 of the wall or building 12.

Each of the quoins 20 may include an outer surface 26 and an inner surface 28, wherein the inner surface 28 comprises a right-angled recess 30 adjacent to the common edge 24 and along the two quoin panels 22. The true edge column 14 may be cooperatively sized to fit within the right-angled recess 30. The quoins 20 may be attached to the true edge column 14 through the use of pre-drilled apertures 32 through the quoins 20 with the use of fasteners 34.

The process may also include the step of applying a primer to the quoins 20. This then prepares to quoins 20 to be later painted. The process may then include the step of caulking around a gap between the quoins 20 and the building structure 12. The process may then also include the step of painting the outer surface of the quoins 20.

FIG. 7 is a perspective view of an exemplary prefabricated quoin installation kit 10 embodying the present invention now installed inside a doorway 38.

A typical corner of a single story home 12 can be installed in under two hours plus caulking and painting. Corners can come packaged with four quoins 20 to package, with both inner and outer corners being available. As can be seen by one skilled in the art, there exists an infinite variety of combinations of styles of individual quoins 20 that can be pre-packaged into sets and this disclosure is not intended to limit it to the precise form described herein. The quoins 20 are pre-drilled and primed for paint with a smooth finish surface typical of wood or concrete.

The typical tools required for installation are a screwdriver, screws, straight edge, 25 foot tape, coping saw, hand saw, hammer, and caulking guns. Other desired, but not necessary tools, can be a power drill, drill bits for masonry and wood, a jigsaw and a circular saw.

To install the quoins 20 on a varied surface such as stucco, stone and bricks, the true edge column 14 facilitates a straight and true, quick easy screw in installation. The true edge column 14 creates the perfect straight corner column and is made out of wood to easily fasten corners to any varied surface. The column 14 can not only be made of wood, but also fiber board, fiberglass, plastic, metal or composite. The column 14 eliminates individually placing each quoin 20 and hoping for perfect alignment between the quoins 20. In the past, quoins 20 were limited to concrete forms on cast or poured corners. This meant that there was not a high level of detail available, and the concrete over foam only offers a stucco finish and limited detail level. Now with pre-fabricated quoins 20, a range of surface textures, colors, and designs with a high level of intricacy attainable are available. The finish can be smooth or textured to simulate whatever the customer desires.

Figure 8:
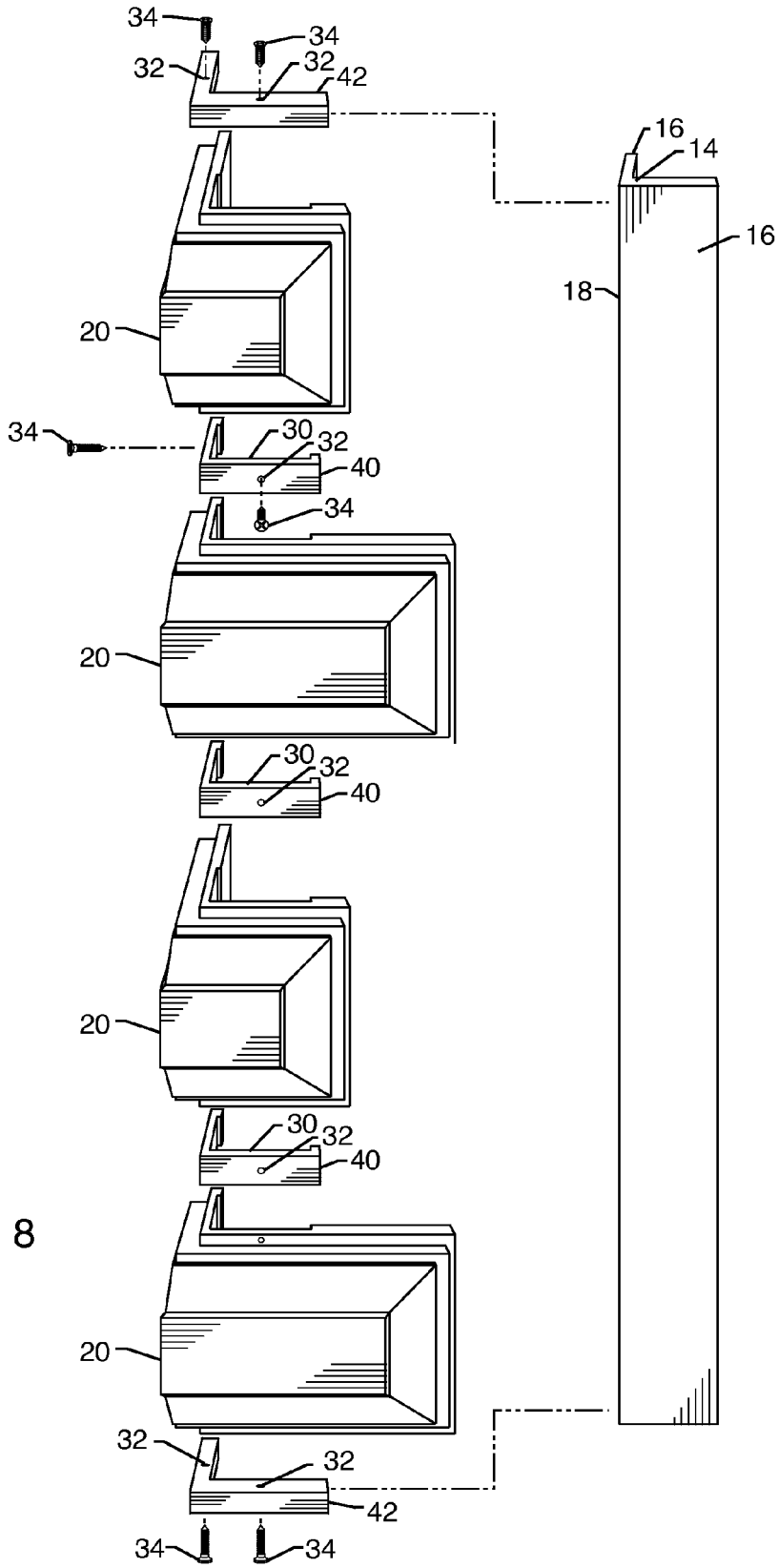
FIG. 8 is an exploded perspective view of another exemplary prefabricated quoin installation kit embodying the present invention.
Figure 9:
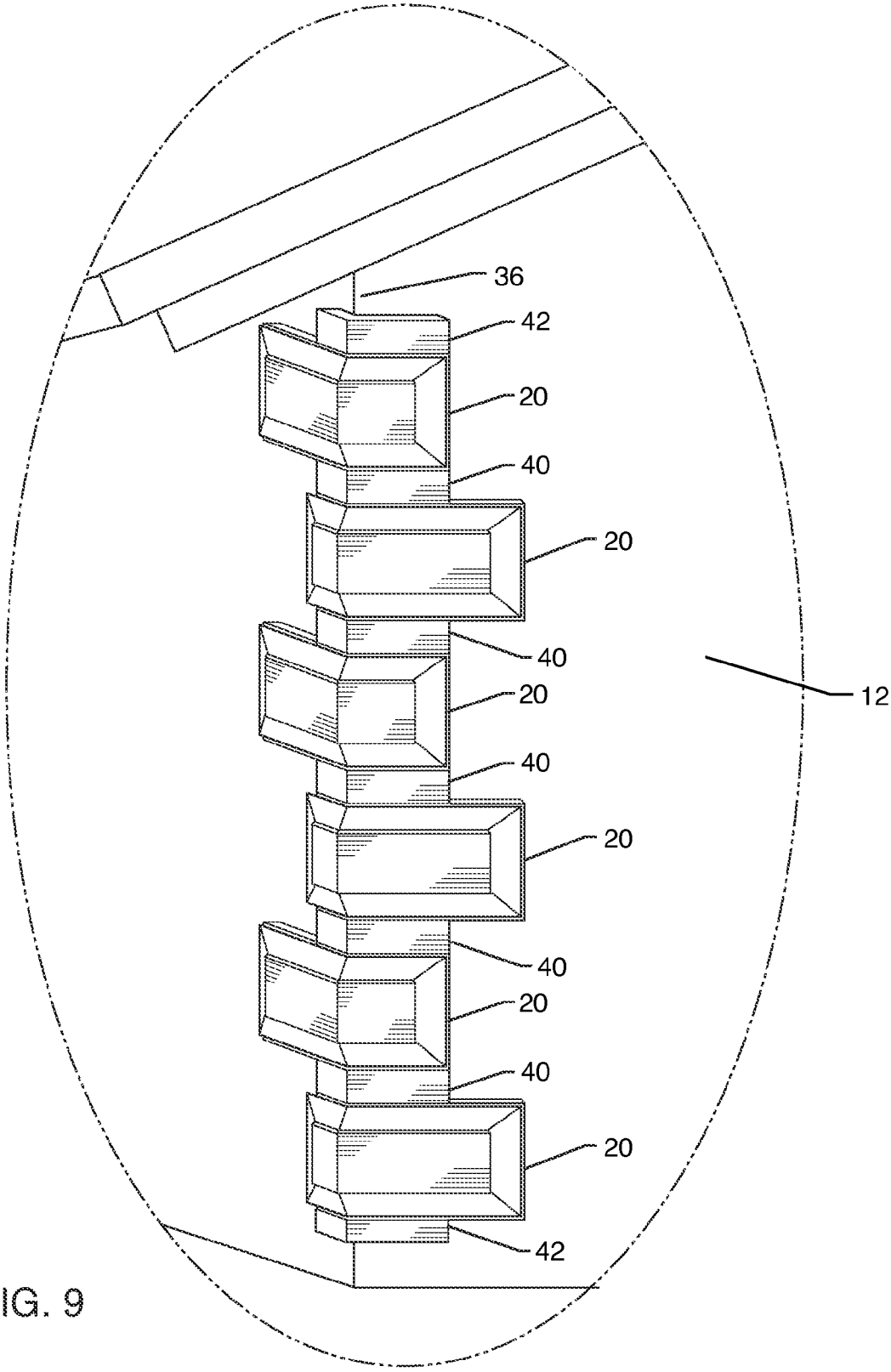
FIG. 9 is a perspective view of the structure of FIG. 8 installed along a corner.

FIG. 8 is an exploded perspective view of another exemplary prefabricated quoin installation kit 10 embodying the present invention and FIG. 9 is a perspective view of the structure of FIG. 8 installed along a corner 36 of a building structure 12. In this embodiment, the quoins 20 have spacers 40 installed between. The spacers 40 are typically smaller than the quoins 20 and can also be fastened to the true edge column 14 through the use of fasteners 34 or other fastening means previously discussed. Each spacer 40 can also have a pre-drilled aperture 32 facilitating installation of fasteners. The spacers 40 can also have right-angle recess 30 disposed therein to facilitate attachment to the true edge column 14.

An end cap 42 can also be attached to the top-most and bottom-most quoins 20. The end cap 42 may also have pre-drilled apertures 32 facilitating installation of fasteners. The end caps 42 and spacers 40 allow a person to vary the designs of the quoins 20. Spacers 40 can be used, not used, or doubled up to create varying architectural designs. The quoins 20 can also have varying lengths of quoins panels 22 as seen in FIGS. 8 and 9. It is to be understood by one skilled in the art that a multitude of designs are possible, as this specific disclosure is not to be limited to the specific figures and designs disclosed herein.

Additionally, the figures herein illustrate the quoins 20 as being all outside quoins 20 to be placed on a protruding corner 36. However, as can be seen by one skilled in the art, the present invention works just as easily on inside corners with inside quoins 20 as well and this disclosure is not limited to the corners being all outside corners 36. Also, the angle of the quoin panels 22 may be formed in different increments for varying corner geometry. For instance, a corner 36 may be a 45 degree corner as opposed to a 90 degree corner. The quoins 20 and true edge column 14 may be adjusted accordingly.

One embodiment of an installation process is detailed hereafter. Step 1: Measure from the drip line up to where you want the last corner accent to end. Mark the place for the top cornerstone (and true edge) to end. Lay true edge up on sawhorses. Step 2: Deduct 5⅜" from total measurement of bottom of drip line to where you want cornerstone to end on the bottom of the column. Now cut the true edge to the length you need. Step 3: Using a straight edge, mark the true edge another 5⅜" from the bottom. Step 4: Now mount what will end up being the 2nd accent corner from the bottom by aligning the bottom edge of accent with your line 5⅜" from the bottom of true edge. Step 5: Install 4 screws (1⅝" decking screws) while holding corner correctly positioned on true edge. Remove true edge from sawhorses and carefully align the top edge of true edge on house at the mark previously made on house for top cornerstone to end (in step #1). Step 6: Install 2 screws or nails (between 3 and 4" length as needed—in brick use concrete anchors) about 1" from outside edge of true edge, one on each side of the true edge going through the true edge, stucco and into the building corner 2×4s. Do not completely install screws until step #7 is completed. Step 7: Now fasten the bottom of the true edge as in step #6. Then fasten the true edge in 2 other equally distant spots in between (e.g. every 3rd accent corner on an 8 foot length). Now you can finish installing all screws all the way in. Step 8: With true edge now properly secured, simply stack, one at a time, the remaining cornerstones going up the side of the building starting with the one immediately on top of the cornerstone you already have in place, installing with 4 screws each corner accent as in step #5 above. Step 9: Note: stucco usually bows out last 6" for drip line. To sit correctly against building (i.e. make it flush with the remaining column corners) fit and trim the inside of the bottom and side edges of the bottom corner accent as necessary to eliminate any bowing affect from the flashing and stucco applications on the last 6" (approx.) of the corner of your building. Install using 2-1⅝" decking screws at the top of the lowest corner accent into the true edge. Using same screws as in step 6, on the two bottom holes of the corner accent (you don't have the true edge behind this portion of the corner accent). The bottom edge of your last cornerstone should now line up with the edge of the drip line. Step 10: Insert wood dowels into the 4 countersunk holes in each corner accent that you just installed onto the true edge. Now tap down using a scrap piece of wood that is larger than the dowel diameter itself so you just tap it flush with the surface of the cornerstone. Step 11: Caulk all outer edges of the cornerstone columns using a good quality, outdoor, paintable caulk. Step 12: Lastly, paint as desired.

Another embodiment of an installation process is detailed hereafter. Measure your house corners where you are installing your accents (quoin panels) and make sure that you have at least 11½" in each direction from that corner free of any rain down spout, etc. If you don't have enough space, reroute any obstacles accordingly. Measure up from the corner of your home or building where you want to install your corner accents starting either at the drip rail edge or above any possible water lines. Measure up to where you want your accents and accent spacers to end and mark both spots. End caps fit over the ends of the tru-edge (true edge column) and are not counted in this measurement. Mark and cut your tru-edge 1/16"-⅛" shorter than the total measurement of the number of both accents and accent spacers that you will use. This will allow enough play for leveling adjustment of the two end pieces on your column. Calculate how many accents and accent spacers will be required for this measurement.

For eave clearance or other clearance, place a corner accent or accent spacer, depending on which you will end with, at your upper finish line to see if there is sufficient clearance. If not, adjust as required by shortening the tru-edge. Note that end caps are used on both your first and last column pieces. The end caps will add ¾" to each end. Remember to take this into account on your overall height. If this is crucial, cut your tru-edge column down by ¾"-1½" as necessary.

Your corner accents have been designed so that 7 accents plus 7 accent spacers plus 2 end caps will equal approximately 8 feet. However, they also have the versatility of being installed on most any length. For example, let's say your actual measurement is 7½ feet or 90 inches. There are two ways to approach this. Option #1: Use 6 corner accents with 6 accent spacers and 2 end caps. This should leave you approximately 8¼" short. Simply divide the 8¼" in half which is 4⅛" and make your mark on both top and bottom 4⅛" up from where you normally would have started, cut your tru-edge to required length and begin. Option #2: Using a table saw, cut down the height of the spacers used to adjust your overall height and spacing, placing the corner accents closer together and using a 7th accent. For taller or two-story applications more than one tru-edge can be butted together.

Using appropriate fasteners, install your cut-to-length tru-edge column by first aligning it with the placement marks, start in the middle of tru-edge and install fasteners. Using a fencepost level, make sure the top of your column is level before installing and tightening top screw anchors. Repeat this on the bottom of column and finish by installing fasteners in the remainder of pre-drilled holes. Now check tru-edge column at each fastener location for an accurate 90 degree angle using a square. Tighten or slightly loosen fasteners as needed to adjust for this angle.

If you applying to stucco, use a masonry drill to pre-drill through stucco and then a wood drill to drill pilot holes in wood. Next install correct length of a high performance outdoor fastener (HPOF) to anchor the column. On stucco, screws should go through both column and stucco and then penetrate the wood by 1¼ inches to 1½ inches. When installing on masonry or brick homes or buildings, use appropriate fasteners. If you miss the wood corner 2×4's you may drill another location on your tru-edge, taking care not to drill a screw hole where either a corner accent or accent spacer will fasten.

Whether you're installing style #1 or style #2 use the same installation method. Starting from the bottom, first install the end cap on the first accent by aligning both inside edges flush with each other. Then drill two holes using a drill bit. Fasten with two 1 inch screws provided. Next install 2 dowels in the predrilled and countersunk holes. Use a scrap of hard wood slightly larger than the dowel, tap lightly with a hammer to act as a buffer to avoid marking your accents or installing your dowels deeper than flush.

Apply a small bead of liquid nails or equivalent adhesive to the inside edges of both accents and accent spacers where they will contact tru-edge before assembly. Place the accent with the end cap installed on bottom of column with end cap butting up to the bottom of column. Then drop it down just enough to allow for leveling adjustment—usually approximately 1/16 of an inch. Next, partially install one #8×1⅝ inch HPOF screw in one of the upper pre-drilled and countersunk holes. Next, place a level on top of the accent and level it. Install 3 remaining 1⅝ inch HPOF screws in the pre-drilled and countersunk holes and tighten all 4 of them. Now place an accent spacer on top of the accent and while holding it in proper position check for both level and leading edge adjustment and fasten it using two #8×1⅝" HPOF screws. You can adjust the accent spacer's leading edge the same way as with the accents. You can slightly tighten or loosen each screw accordingly for required leading edge adjustment of each accent. Continue this process until done; repeating the end cap installation on the top or last piece you install the same as you did on the bottom of the first accent.

It is possible to prepaint both the corner accents and accent spacers to avoid masking. It is advisable to cover the countersunk holes with a piece of masking tape to avoid getting any paint in these holes, as it would cause the wood to split when installing dowel plugs. Corner accents and accent spacers can be trimmed as necessary to fit around existing fascia boards, etc. Remember to be consistent with your pattern on all corners. You can go small to large, large to small, or skip the spacers and go with accents next to each other. Tap in remaining dowels using the same process described earlier.

Using a good grade of paintable caulking, caulk around the edges of accents and spacers. Depending on the size of gaps this may need to be done in more than a single application. Lightly sand corner accents and spacers if necessary before painting with an appropriate paint. So there it is—a beautiful and easy-to-install cornerstone accent for your house, apartment, commercial/retail or industrial building. In addition to using premade accents, it is also possible to use custom designs and sizes.

Although several embodiments have been described in detail for purposes of illustration, various modifications may be made to each without departing from the scope and spirit of the invention. Accordingly, the invention is not to be limited, except as by the appended claims.

What is claimed is:

1. A process for installing prefabricated decorative quoins to existing corners and walls of a building structure, the steps comprising:

fabricating a plurality of quoins, each comprising first and second quoin panels angularly disposed relative to each other and connected along a common edge, each of the plurality of quoins having a right-angled recess extending from the common edge on an inner surface thereof, wherein the first quoin panel extending from the common edge has a length greater than a length of the second quoin panel extending from the common edge, and wherein the recess does not extend the length of both the first and second quoin panels from the common edge;

attaching a true edge column to a corner formed between adjacent first and second walls of the building structure, the true edge column comprising two column panels perpendicularly disposed relative to each other along a common column edge and providing a straight corner on an exterior surface of the true edge column, a first panel of the true edge column disposed over the first wall and a second panel of the true edge column disposed over the second wall, wherein the first and second panels of the true edge column are sized to fit within the recess of each of the plurality of quoins, the true edge column having a longitudinal length approximately the height of a portion of the building structure to which the plurality of quoins are to be installed;

attaching the plurality of quoins in stacked relation over and to the true edge column, such that the straight corner of the first and second panels of the true edge column are disposed within the recess of each of the plurality of quoins and the true edge column does not extend beyond the recess; and alternating orientations of the stacked plurality of quoins, such that the first quoin panel of each of the plurality of quoins is stacked adjacent to the second quoin panel of another of the plurality of quoin panels.

2. The process of claim 1, wherein the two-first and second quoin panels are perpendicularly disposed relative to each other.

3. The process of claim 1, wherein the step of attaching the plurality of quoins in stacked relation over and to the true edge column comprises the step of placing the plurality of quoins above one another and aligned with the corner of the first and second walls of the building structure.

4. The process of claim 1, including the step of applying a primer to the plurality of quoins.

5. The process of claim 1, including the step of painting an outer surface of the plurality of quoins.

6. The process of claim 1, wherein the step of attaching the plurality of quoins to the true edge column includes inserting fasteners through pre-drilled apertures in the plurality of quoins.

7. The process of claim 1, wherein each of the plurality of quoins includes a stylized texture outer surface.

8. The process of claim 1, including the step of installing a spacer between each of the plurality of quoins.

9. The process of claim 1, including the step of installing an end cap above an upper-most quoin of the plurality of quoins and below a lower-most quoin of the plurality of quoins.

10. A process for installing prefabricated decorative quoins to existing corners and walls of a building structure, the steps comprising:

fabricating a plurality of quoins, each comprising first and second quoin panels perpendicularly disposed relative to each other and connected along a common edge, wherein the first quoin panel extending from the common edge has a length greater than a length of the second quoin panel extending from the common edge and;

attaching a true edge column along and aligned with a corner of walls of the building structure, the true edge column comprising two column panels perpendicularly disposed relative to each other along a common column edge and providing a straight corner on an exterior surface of the true edge column, the true edge column having a longitudinal length approximately the height of a portion of the building structure to which the plurality of quoins are to be installed;

attaching the plurality of quoins in stacked relation over and to the true edge column, wherein each of the plurality of quoins comprises an outer and an inner surface wherein the inner surface comprises a right-angled recess extending from the common edge and along the first and second quoin panels, wherein the recess does not extend the length of both the first and second quoin panels from the common edge, where the straight corner of the true edge column is cooperatively sized to fit within the right-angled recess and the true edge column does not extend beyond the recess; and alternating orientations of the stacked plurality of quoins, such that the first quoin panel of each of the plurality of quoins is stacked adjacent to the second quoin panel of another of the plurality of quoin panels.

11. The process of claim 10, including the step of painting the outer surface of the plurality of quoins.

12. The process of claim 10, wherein the step of attaching the plurality of quoins includes inserting fasteners through at least one of a plurality of pre-drilled apertures in each of the plurality of quoins to facilitate fastening the plurality of quoins to the true edge column.

13. The process of claim 10, wherein each of the plurality of quoins includes a stylized texture outer surface.

14. A prefabricated decorative quoin installation kit for attachment to existing corners and walls of a building structure, the kit comprising:

a true edge column comprising two column panels angularly disposed relative to each other and connected along a common column edge and providing a straight corner on an exterior surface of the true edge column, such that a first panel of the true edge column is disposable over a first wall of the building structure and a second panel of the true edge column is disposable over a second wall of the building structure adjacent to the first wall, the true edge column having a longitudinal length approximately the height of a portion of the building structure to which the kit is to be installed; and a plurality of stackable prefabricated quoins, each comprising first and second quoin panels perpendicularly disposed relative to each other and connected along a common quoin edge, wherein the first quoin panel extending from the common edge has a length greater than a length of the second quoin panel extending from the common edge, each of the plurality of stackable prefabricated quoins comprising an outer and inner surface wherein the inner surface comprises an angular recess extending from the common quoin edge for receiving the straight corner of the true edge column therein, and wherein the recess does not extend the length of both the first and second quoin panels from the common edge.

15. The kit of claim 14, wherein the two column panels are perpendicularly disposed relative to each other.

16. The kit of claim 14, wherein each of the plurality of stackable prefabricated quoins comprise a plurality of pre-drilled apertures for facilitating attachment of the plurality of stackable prefabricated quoins to the true edge column.

17. The kit of claim 14, wherein each of the plurality of stackable prefabricated quoins comprises a stylized texture outer surface.

18. The kit of claim 14, wherein the plurality of stackable prefabricated quoins comprise wood, composite, metal, fiberglass or plastic.

19. The kit of claim 14, wherein the plurality of stackable prefabricated quoins comprise at least two different types of complementary quoins.

20. The kit of claim 14, including a spacer for providing distance between each of the plurality of stackable prefabricated quoins such that each of the plurality of stackable prefabricated quoins is not in contact with any other quoin.

21. The kit of claim 14, including an end cap for capping either an upper-most quoin of or a lower-most quoin of the plurality of stackable prefabricated quoins.

* * * * *